US008430199B2

(12) United States Patent
Stephenson et al.

(10) Patent No.: US 8,430,199 B2
(45) Date of Patent: Apr. 30, 2013

(54) SOUND SHELL

(75) Inventors: Mark Stephenson, London (GB); Jason Flanagan, London (GB); Paul Bavister, London (GB); Ian Knowles, London (GB)

(73) Assignee: Sound Forms PLC, London (GB)

( * ) Notice: Subject to any disclaimer, the term of this patent is extended or adjusted under 35 U.S.C. 154(b) by 0 days.

(21) Appl. No.: 13/387,886

(22) PCT Filed: Oct. 26, 2009

(86) PCT No.: PCT/GB2009/002536

§ 371 (c)(1),
(2), (4) Date: Apr. 27, 2012

(87) PCT Pub. No.: WO2011/012835

PCT Pub. Date: Feb. 3, 2011

(65) Prior Publication Data

US 2012/0198777 A1 Aug. 9, 2012

(30) Foreign Application Priority Data

Jul. 29, 2009 (GB) ..... 0913239.0

(51) Int. Cl.
*E04B 1/99* (2006.01)

(52) U.S. Cl.
USPC ..... 181/30; 181/287

(58) Field of Classification Search ..... 181/30, 181/287
See application file for complete search history.

(56) References Cited

U.S. PATENT DOCUMENTS

| | | | | |
|---|---|---|---|---|
| 1,238,228 | A * | 8/1917 | Weil | 52/67 |
| 1,675,102 | A | 6/1928 | Holland | |
| 1,881,146 | A | 11/1931 | Sugar | |
| 3,217,366 | A | 11/1965 | Wenger | |
| 3,417,518 | A | 12/1968 | Jaffe | |
| 3,630,309 | A * | 12/1971 | Wenger et al. | 181/30 |
| 3,672,463 | A | 6/1972 | Jaffe | |
| 4,278,145 | A | 7/1981 | Eade et al. | |
| 4,356,880 | A * | 11/1982 | Downs | 181/30 |
| 4,720,945 | A * | 1/1988 | Berranger et al. | 52/7 |
| 4,750,586 | A | 6/1988 | Lerner et al. | |

(Continued)

FOREIGN PATENT DOCUMENTS

CA 1107066 8/1984

OTHER PUBLICATIONS

International Search Report dated Apr. 22, 2010.

(Continued)

*Primary Examiner* — Jeremy Luks
(74) *Attorney, Agent, or Firm* — RatnerPrestia

(57) ABSTRACT

A performance shell (1) for outdoor music performance including a platform (2) providing a performance area for receiving at least one sound source, the platform combining unitarily with a rear wall reflectors (5), side wall reflector (6) and a canopy reflector (7) to define an enclosure having a front opening (11) for communicating acoustically with an open air audience area. The canopy reflector includes a main portion (8) extending above the performance area and a projecting portion (9) projecting forwardly of a front edge of the performance area, the canopy reflector further including sound diffusion formations (13) on an underside of the main portion and the projecting portion and adapted to provide non-specular reflection of sound from the at least one sound source for enhancing sound received both in the performance area and the audience area.

17 Claims, 10 Drawing Sheets

SOUND SHELL

U.S. PATENT DOCUMENTS

| | | | | |
|---|---|---|---|---|
| D304,083 | S | 10/1989 | Jenne | |
| 5,168,129 | A | 12/1992 | D'Antonio | |
| 5,400,551 | A | 3/1995 | Uhl | |
| 5,525,766 | A * | 6/1996 | Atcheson et al. | 181/30 |
| 5,530,211 | A | 6/1996 | Rogers et al. | |
| 5,646,378 | A | 7/1997 | Van Haaff et al. | |
| 6,530,451 | B2 | 3/2003 | Noselli | |
| 7,600,608 | B2 | 10/2009 | Freiheit | |
| 2006/0060420 | A1 | 3/2006 | Freiheit | |
| 2008/0190690 | A1 | 8/2008 | Waters | |

OTHER PUBLICATIONS

Final Office Action for U.S. Appl. No. 12/608,392, filed Oct. 29, 2009, mailed Jun. 8, 2011.
Final Office Action for U.S. Appl. No. 12/608,392, filed Oct. 29, 2009, mailed Nov. 26, 2010.
Non Final Office Action for U.S. Appl. No. 12/608,392, filed Oct. 29, 2009, mailed Aug. 3, 2010.
Vela et al., "Comparative Analysis of Two Acoustic Simulation Software", http://www.seaacustica.es/Sevilla02/arcgen002.
Odeon Room Acoustics Software, Odeon Room Acoustics Software for Prediction and Auralisation of Acoustics, http://www.seaodeon.dk Jul. 2009.
Studio A—Acentech for the Arts, http://www.acentech.com/studIOA/images/pdfs/studioabrochure May 7, 2009.
Secoa, "Material on Orchestra Shells," http://www.secoa.com/secShellssystemc.cfm 2009.
Oeler Industries, Inc., "Material on Diffusors/Reflectors," http://www,OOELER.COM/cp,/diffusers.html 2007-2009.
Suono Vivo, "Camera Acustica Per Orchestra—The Project", http://www/suonovivo.it/eng/project.htm 1998-2009.
Dammerud, et al., "Early Subjective and Objective Studies of Concert Hall Stage Conditions for Orchestral Performance", 19th Internatinal Congress on Acoustics, Madrid, pp. 1-6, Sep. 2-7, 2007.
Suono Vivo, "Spontaneous Applause: The Suono Vivo Outdoor Acoustic Chamber", http://www.suonovivo.it/eng/outdoor/pdf 2009.
Secoa, "Orchestra Shells", http://www.secoa.com/secShellssystems.cfm Jul. 7, 2009.
Supertech, "Supertech—Stageright," http://.supertechInc.com/p-acs-stageright.html 2007.
R. Nave., "Reflection of Sound, Phase Change Upon Reflection, Pressure Zone", http://hyperphysics.phyastr.gsu.edu/HBASE/Sound/reflec.html Jan. 24, 2005.
Magne Skalevik, "Orchestra Canopy Arrays—Some Significant Features", Joint Baltic-Nordic Acoustics Meeting 2006 Sweden, pp. 1-9.
Barron et al., Stage Acoustics in Concert Halls—Early Investigations, Proceedings of the Institute of Acoustics, vol. 28, Pt. 2, 2006.
Monks, et al., "Audioptimization: Goal-Based Acoustic Design", IEEE Computer Graphics and Applications (May/Jun. 2000) 76-91.
Brandon Safford, "Idea: Sundial Ampitheater", http://idreamofarchitecture.blogspot.com/2009/06/idea-sundial-ampitheater.html 2009.

* cited by examiner

SOUND SHELL

REFLECTING SURFACES IN ONE HALF OF SOUND SHELL

PLAN VIEW OF SHELL

SOUND VECTORS FROM A SPECIFIC SOUND SOURCE

PERFORMANCE STRUCTURE INCORPORATING SHELL

OUTER CLADDING OF PERFORMANCE STRUCTURE

SOUND SHELL

CROSS REFERENCE TO RELATED APPLICATIONS

This application claims priority to International Application No. PCT/GB2009/002536, filed Oct. 26, 2009, the contents of which are incorporated herein by reference.

FIELD OF THE INVENTION

This invention relates to sound shells of the type which are used for music performance.

BACKGROUND

It is known to provide the stage of a concert hall or similar building with a sound shell, the sound shell providing reflecting surfaces which enhance the sound projected towards the audience area and reduce loss of sound in the direction of the back, sides and ceiling of the stage area. Such sound shells have also been found to improve the acoustic conditions in a performance area of the stage in a manner which enhances the way in which musicians in the performance area hear their own performance and the performances of other musicians and thereby tends to improve the quality of performance.

Typically in such indoor sound shells, reflective panels are supported by permanent structures around the stage and other reflectors above the stage or audience area may be supported from the roof of the building. Alternatively, sound shells have been proposed, as in U.S. Pat. No. 5,530,211, which are transportable and of modular construction so as to be readily erected and dismantled. Such temporary structures typically comprise reflecting panels on supporting towers.

When a performance is to take place in the open air, musicians may be provided either with a permanent or temporary stage structure which may provide a roof, rear wall and possibly side walls, but which invariably does not compare with the acoustic properties available to both musicians and audience within a concert hall having a stage with a stage with a sound shell. U.S. Pat. No. 4,278,145 proposes providing a concert shell for outdoor use and comprising a plurality of similarly constructed sections which can be erected and connected to form a shell, each section having an upright panel and a cantilevered upper section which can be tilted forwardly.

SUMMARY

There remains a need to provide an improved sound shell for use in outdoor situations.

According to the present invention, a performance shell for outdoor music performance comprises;

a platform providing a performance area for receiving at least one sound source, the platform combining unitarily with a rear wall reflector, side wall reflector and a canopy reflector to define an enclosure having a front opening for communicating acoustically with an open air audience area;

the canopy reflector comprising a main portion extending above the performance area and a projecting portion projecting forwardly of a front edge of the performance area, the canopy reflector further comprising sound diffusion formations on an underside of the main portion and the projecting portion and adapted to provide non-specular reflection of sound from the at least one sound source for enhancing sound received both in the performance area and the audience area.

Preferably the side wall reflectors and the rear wall reflector comprise planar reflecting surfaces and the main portion of the canopy reflector comprises a plurality of convex part-cylindrical reflectors distributed over a concave part-cylindrical surface extending from a top edge of the rear wall reflector to a position vertically above the front edge of the performance area.

Preferably the convex reflectors have a radius of curvature in the range 2.8 to 4.2 meters.

Preferably each of the reflectors is formed of material have a density of least 10 kilograms per square meter.

In one embodiment the height of the canopy reflector above the front edge of the performance area is G, the height of the back wall is D, and G and D are related by the equation $G=2.4D\pm10\%$. The separation between the side walls at the front of the performance area is C, the separation of the side walls at the rear of the platform is B, and wherein C and B are related by the equation $C=1.43B\pm10\%$. The height of the back wall reflector is D, the depth of the performance area from its front edge to rear is A, and wherein D and A are related by the equation $D=0.5A\pm10\%$. The canopy extension means extends from the main portion at an angle of elevation in the range 0 to 10 degrees above the horizontal. In one embodiment, the arc radius of the canopy reflector is H, the depth of the performance area from its front edge to rear edge is A, and wherein H and A are related by the equation $H=A\pm10\%$.

Preferably the canopy extension projects forwardly from the main portion by a distance of not less than 10 meters.

The front edge of the performance area may be defined by a line joining the points of intersection of the platforms and front edges of the side wall reflectors.

Also disclosed is a free standing performance structure comprising a sound shell in accordance with the present invention, and a support structure adapted to support the side wall reflectors, the rear wall reflector the canopy reflector comprising the sound shell in cooperative relationship.

The free standing performance structure may further comprise an outer cladding encasing the sound shell and support structure and the sound shell, support structure and outer cladding are of modular construction and adapted to be demountable and transportable.

BRIEF DESCRIPTION OF THE DRAWINGS

Embodiments in the present invention will now be described by way of example and with reference to the accompanying drawings of which.

DETAILED DESCRIPTION

Figure 1:
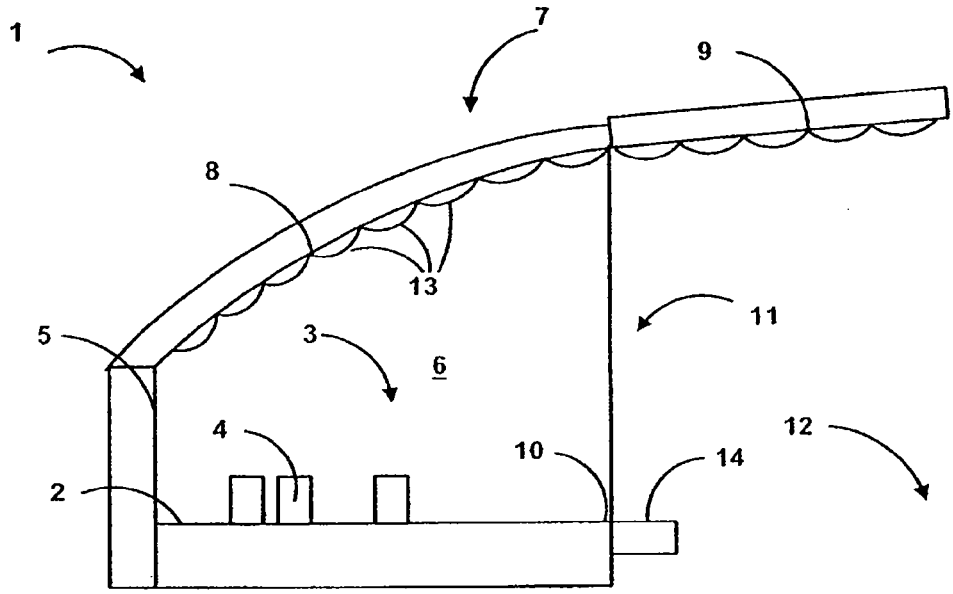
FIG. 1 is a schematic sectional elevation of a sound shell.

FIG. 1 illustrates schematically an embodiment of the invention in which a sound shell 1 comprises a platform 2 which defines a performance area 3 for one or more musicians and instruments, represented schematically in FIG. 1 as sound sources 4. It is to be appreciated however that in the present context the sound sources 4 could also be singers of orators. As such, the sound sources 4 are typically a group of sources located at different parts of the performance area 3. The performance area 3 extends the full width of the platform 2 and has a rear edge at the rear edge of the platform. The performance area 3 is the available space in which the musicians may perform and typically includes all of the platform surface, although some areas may be excluded depending on the shape of the platform.

The sound shell 1 comprises a number of acoustically reflecting surfaces, hereafter referred to as reflectors, for reflecting sound with minimum absorption.

The sound shell 1 has a vertical rear wall reflector 5 and vertical side wall reflectors 6 and is covered by a canopy reflector 7 which is represented in FIG. 1 as having a main portion 8 which extends above the performance area 3 and a projecting portion 9 which projects forwardly of a front edge 10 of the performance area.

The platform 2 therefore combines unitarily with the rear wall 5, the side wall reflectors 6 and canopy reflector 7 to define an enclosure having a front opening 11 communicating acoustically between the performance area 3 and an open air audience area 12.

The canopy reflector 7 is provided on its under surface with sound diffusion formations 13 for providing non-specular reflection of sound. The main portion 8 of the canopy reflector 7 is of curved shape when viewed in side elevation, generally defined by part of the surface of a cylinder having a horizontal axis extending transversally of the platform 2 so that the sound diffusion formations 13 are distributed over a generally concave supporting surface.

Although shown in FIG. 1 as separate but joined items, the main portion 8 and projecting portion 9 may be integrally formed and are described here as separate entities for convenience.

As shown in FIG. 1, the projecting portion 9 is inclined upwardly at an angle of between 0 and 10 degrees to the horizontal in a direction away from the main portion 8.

A front of stage extension 14, not forming part of the performance area 3, projects forwardly at the front edge of the platform 2. In this example, the front of edge 10 of the performance area 3 is defined by a line 10 joining the points of intersection of the surface of the platform 2 and the vertical front edges of the side wall reflectors 6.

Figure 2:
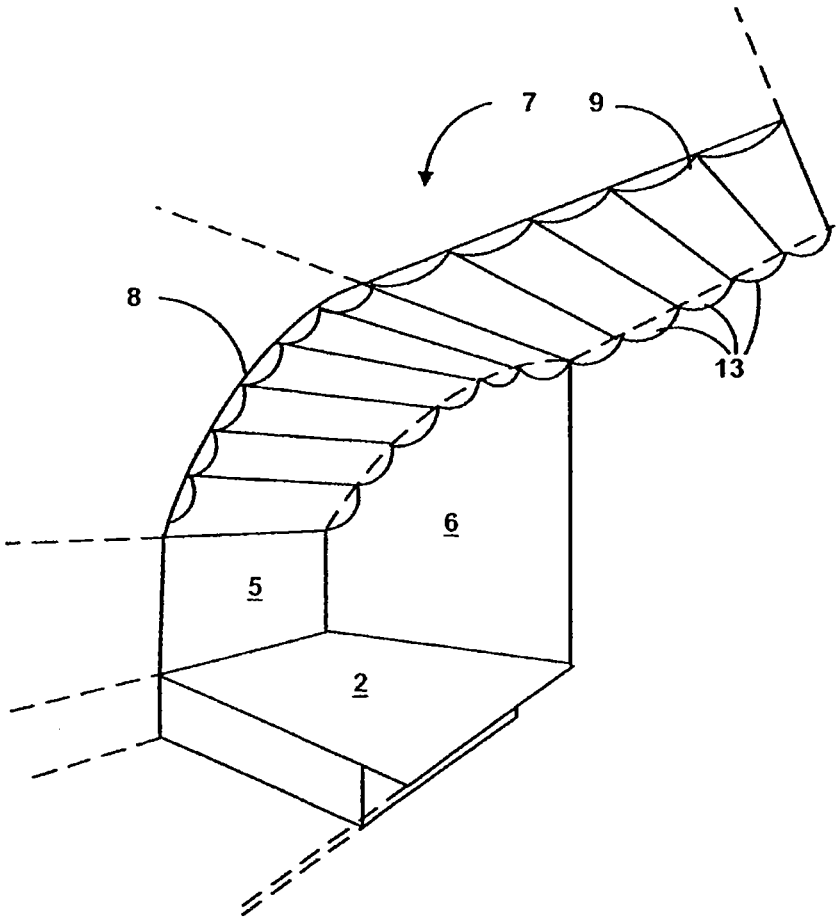
FIG. 2 is a perspective cut away view showing the reflective surfaces in one half of the sound shell of FIG. 1.

FIG. 2 shows more clearly the sound reflecting surfaces provided within the sound shell 1. FIG. 2 is a cutaway perspective view showing one half of the sound shell 1. As is the case for FIG. 1, external cladding and other decorative and functional detail related to stage use have been omitted for clarity and there is therefore no representation of lighting rigs suspended from above or of orchestral risers typically used in an orchestral situation and which would normally be located on the platform 2 during a performance.

The sound diffusion formations 13 comprise a series of convex reflectors, each being part cylindrical in shape with respective horizontal cylindrical axes extending transversally of the platform 1.

Figure 3:
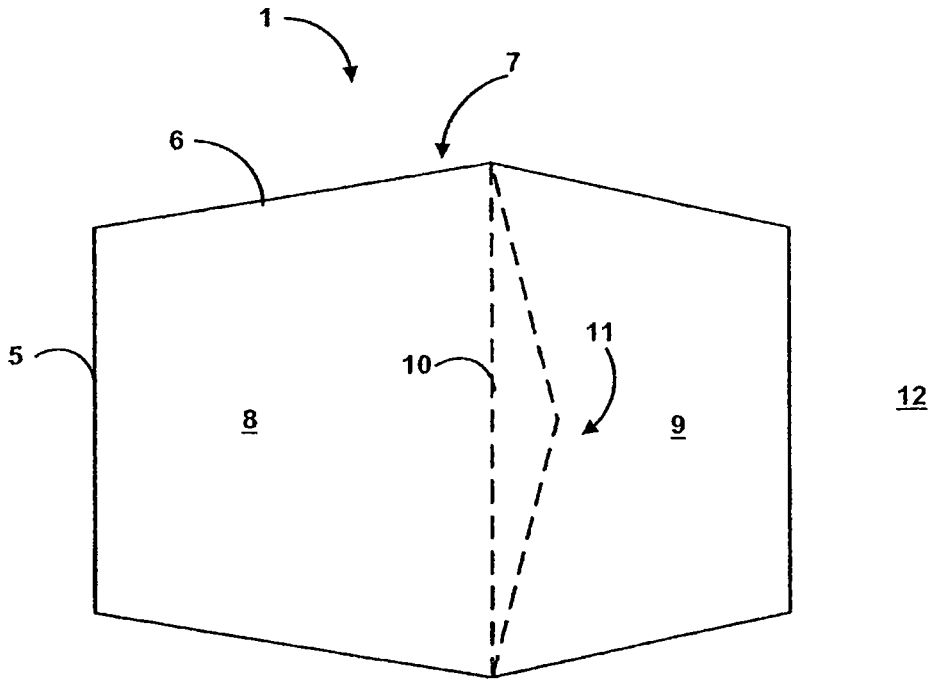
FIG. 3 is schematic plan view of the reflective surfaces of the sound shell of preceding figures.

FIG. 3 illustrates schematically in plan view the extent of the reflective surfaces provided internally by the shell 1, in particular illustrating that the side wall reflectors 6 are splayed in the forward direction and that the projecting portion 9 of the canopy reflectors 7 tapers slightly in the forward direction.

Figure 4:
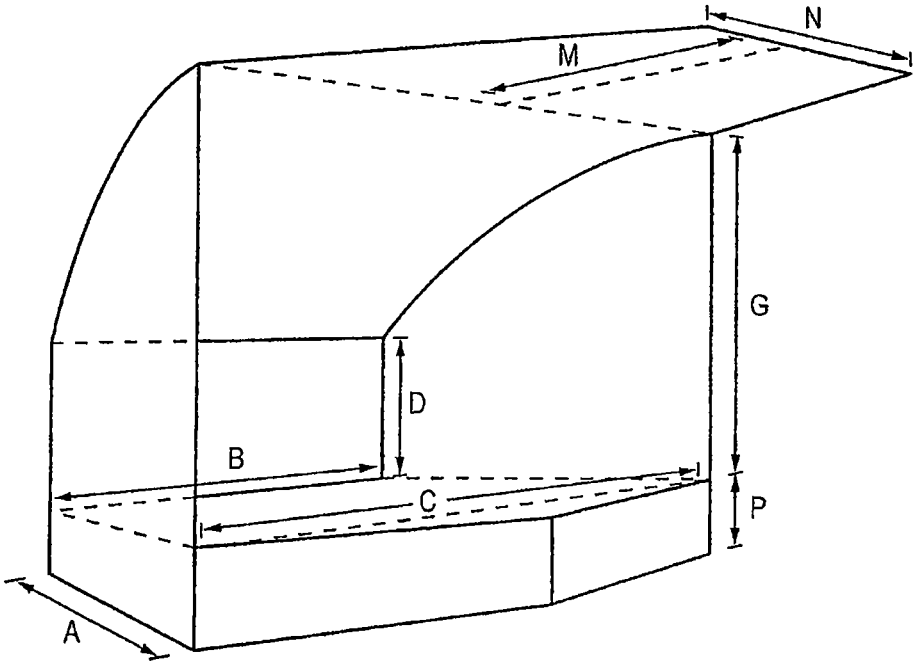
FIG. 4 is schematic perspective view of the sound shell of preceding figures for the purpose of identifying dimensions.

FIG. 4 is provided for convenience in defining parameters referred to in the following discussion of dimensions.

In the following examples, dimensions will be given for a large sized shell 1 with a performance area 3 accommodating an eighty piece orchestra. It is envisaged that a medium sized shell would also be produced for accommodating a forty five piece orchestra and a small sized shell for a sixteen piece orchestra.

In the large sized shell 1 of the present embodiment, the depth A of the performance area 3 is 14.4 meters, the width B of the platform at the rear edge is 14 meters and the width C of the platform at its front edge is 20 meters. The height D of the back wall reflector is 5 meters.

The platform 2 has a height P above ground which is 1.5 to 3 meters.

The height G of the canopy reflector 7 at its front edge, above the front edge of the performance area 3, is 12 meters. The canopy reflector 7 has a curvature between its rear and front edges with a radius H equal to the depth of performance area A, in this example being 14.4 meters.

The projecting portion 9 of the canopy reflector 7 projects forwardly of the front edge 10 of the performance area 3 by a distance M which is at least 10.5 meters, the width N of the projecting portion at its forward edge being equal to B, the width of the platform at its rear edge.

Figure 5:
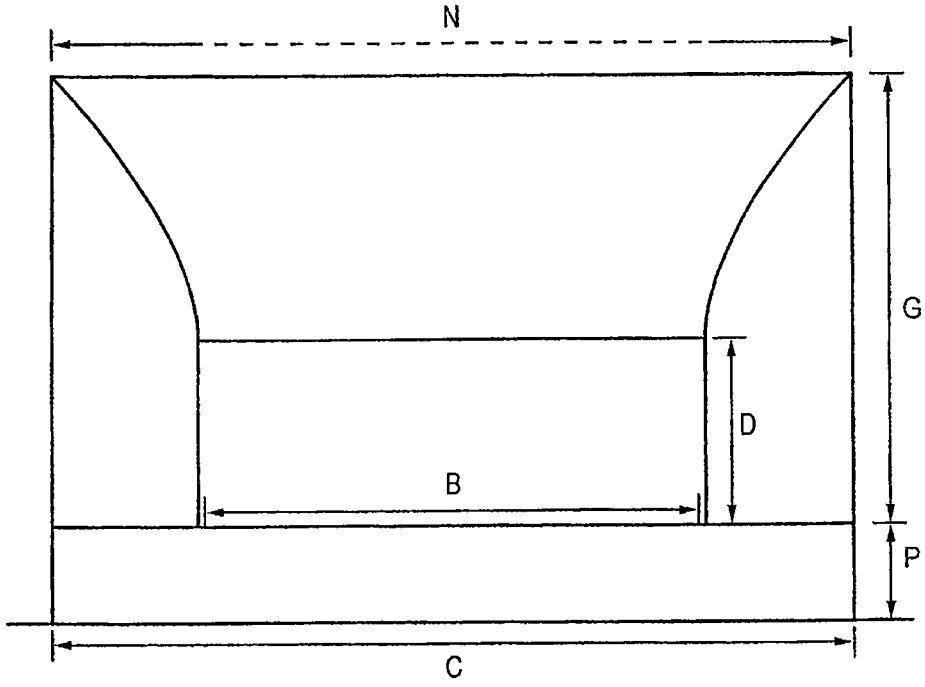
FIG. 5 is a schematic front elevation of the sound shell of preceding figures for the purpose of identifying dimensions.

The above parameters are further illustrated in FIG. 5.

Figure 6:
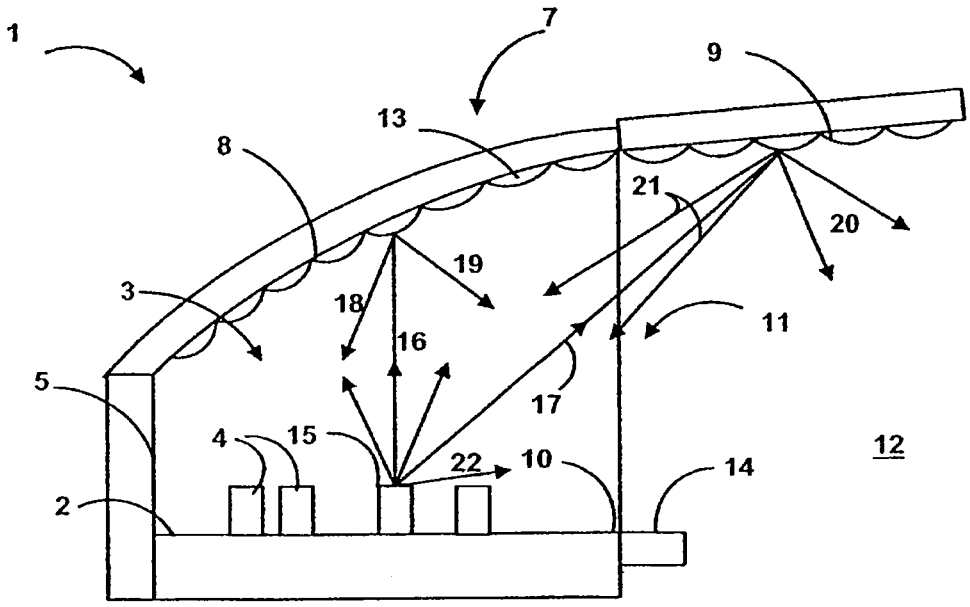
FIG. 6 is a schematic diagram of the sound shell of preceding figures illustrating sound vectors from a specific sound source.

FIG. 6 illustrates schematically the manner in which sound is reflected by the canopy reflector 7. Sound from a specific sound source 15, for example a cello, generates sound waves which, for the purpose of demonstration, are considered to include sound vectors 16 and 17 directed respectively towards the main portion 8 and projecting 9 of the canopy 7.

Sound vector 16 is incident on one of the sound diffusion formations 13 of the main portion 8 and is scattered in multiple directions including vector 19 representing sound reflected forwardly to the audience area 12 and vector 18 representing sound reflected back to the performance area 3.

Similarly, sound vector 17 is scattered in multiple directions from a sound diffusion formation 13 of the projecting portion 9 of the canopy reflector 7 so that sound vectors 20 represent sound reflected forward to the audience area 12 and sound vectors 21 represent sound reflected back towards the performance area 3.

The projecting portion 9 of the canopy reflector 7 therefore provides a distinct advantage in the context of open air performance since sound such as sound vector 17 which would otherwise be lost to the atmosphere is rendered useful by reflection to both performance area 3 and audience area 12 and, at least to some extent, compensates for the lack of an enclosed auditorium which in a concert hall provides acoustic feedback to the musicians and provides and ambience or presence characteristic of the concert hall. The presence of the projecting portion 9 in other words contributes to the amount of reflected and reverberating sound experienced by the musicians in the performance area 3, in addition to improving the loudness of received sound in the audience area 12 by downwardly deflecting sound which would otherwise be lost.

Sound reflected to the performance area 3 as illustrated above is useful both for the musician playing the specific instrument 15 and to musicians playing other instruments represented by the sound sources 4. Multiple reflections may also occur from the side wall reflectors, rear wall reflector, platform surface and other reflectors of the canopy reflector 7.

The net effect within the performance area 3 is to provide enrichment of the sound which helps the performers in multiple aspects of their musical performance.

The forward directed sound vectors 19 and 20 reinforce sound vector 22 from the specific source 4 which travels directly towards the audience area 12. The audience are thereby provided with improved loudness and enriched sound in terms of reverberation qualities achieved by reflection and mixing of the sounds from the different sound sources 4 at different locations in the performance area 3.

Figure 7:
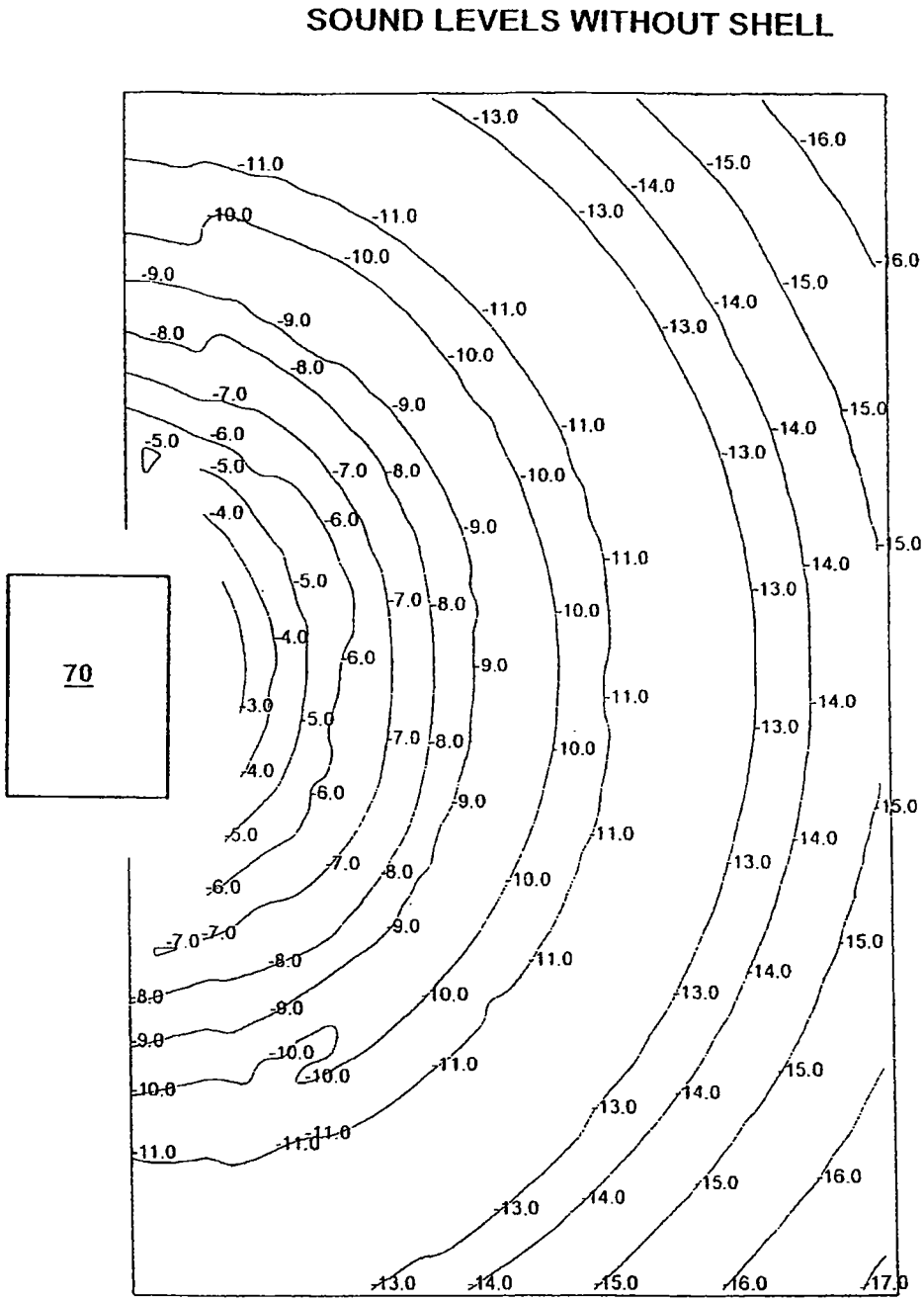
FIG. 7 is a mapping of sound level contours for a sound source on a platform without a sound shell.
Figure 8:
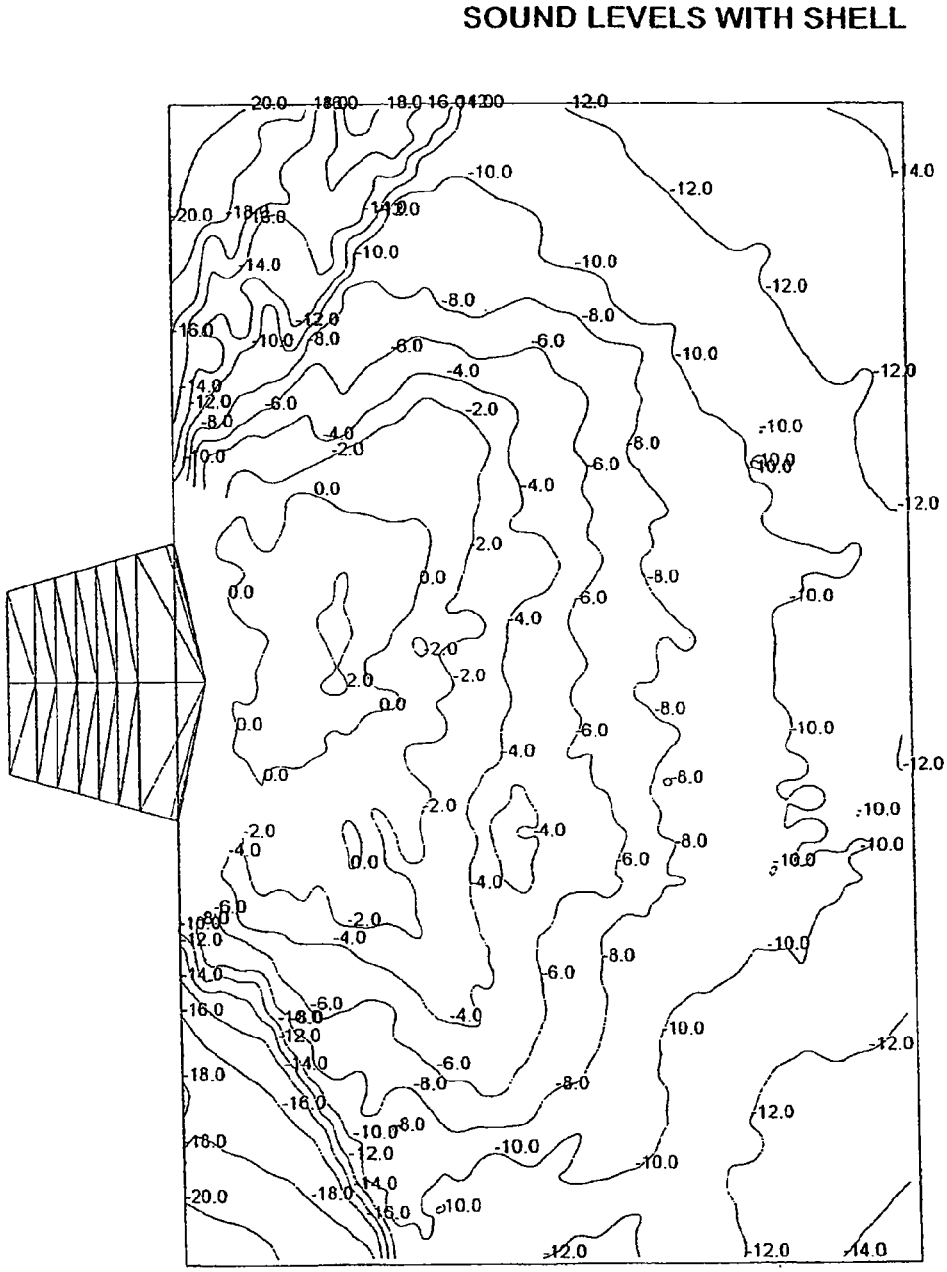
FIG. 8 is a corresponding mapping of sound levels when the sound shell of FIGS. 1 to 6 is present.

FIGS. 7 and 8 represent schematically the results of modeling the effects of the reflecting surfaces provided by the sound shell 1. FIG. 7 represents the sound distribution in the audience area 12 from an orchestra performing on a platform 70 without a sound shell and which therefore does not have the side wall reflectors, rear wall reflectors and canopy reflector of the sound shell 1 of the present embodiment. The contours are labeled with numbers which represent the ratio of sound intensity at a position in the audience area to the sound level on the platform 70, expressed logarithmically so that for example −3.0 represents a loss of 3 db.

FIG. 8 illustrates corresponding contours when the sound shell 1 of the present embodiment replaces the platform of FIG. 7. A comparison of the contour values demonstrates clearly the improvement. For example, the area immediately in front of the platform 70 in FIG. 7 has a level of −3.0 whereas in FIG. 8 the corresponding figure immediately in front of the sound shell 1 is 0 db. It is readily apparent that there is a significant improvement in loudness of sound throughout the audience area 12.

The same modeling technique has been used to measure the predicted ST1 stage support figure parameter, this being the accepted measurement of quality of sound in a performance area for orchestral or other work. The ST1 value obtained by simulation equated substantially with the ST1 value achievable in a conventional indoor sound shell of a concert hall.

The acoustic simulation referred to above was carried out using Odeon (trademark) room acoustics software developed for prediction and auralisation of acoustics.

Figure 9:
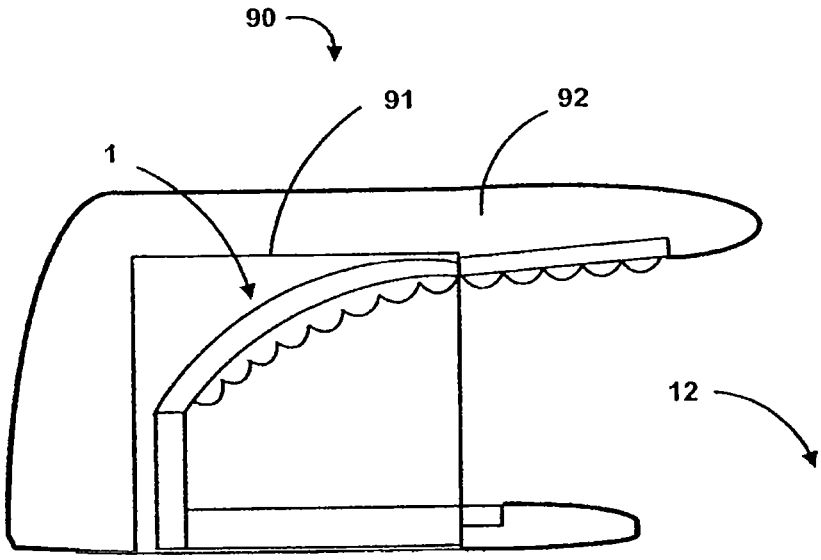
FIG. 9 is schematic sectional elevation of a free standing performance structure comprising a sound shell.

FIG. 9 illustrates schematically how the sound shell 1 of the above described embodiment may be incorporated into a free standing performance structure 90 which may for example be erected in any open space as either a fixed or temporary structure for concert performances. The structure 90 includes a support structure 91 within which the performance shell 1 is located and may for example comprise a modular framework to which acoustically reflecting panels are attached. Alternatively, the rear wall reflector 5, side wall reflectors 6 and canopy reflector 7 may be formed of material sufficiently rigid to form a self standing structure requiring little or no support structure.

An outer cladding 92 envelopes the sound shell and support structure 91, leaving open the front opening 11, but otherwise providing protective and decorative functions. The outer cladding 92 is provided with rounded edges to avoid introducing acoustic artifacts in the distribution of sound from the performance shell 1. The outer cladding 92 is also formed of materials which are as far as possible acoustically neutral to avoid unwanted reflection and absorption, particularly for those portions adjacent to the front opening 11.

Figure 10:
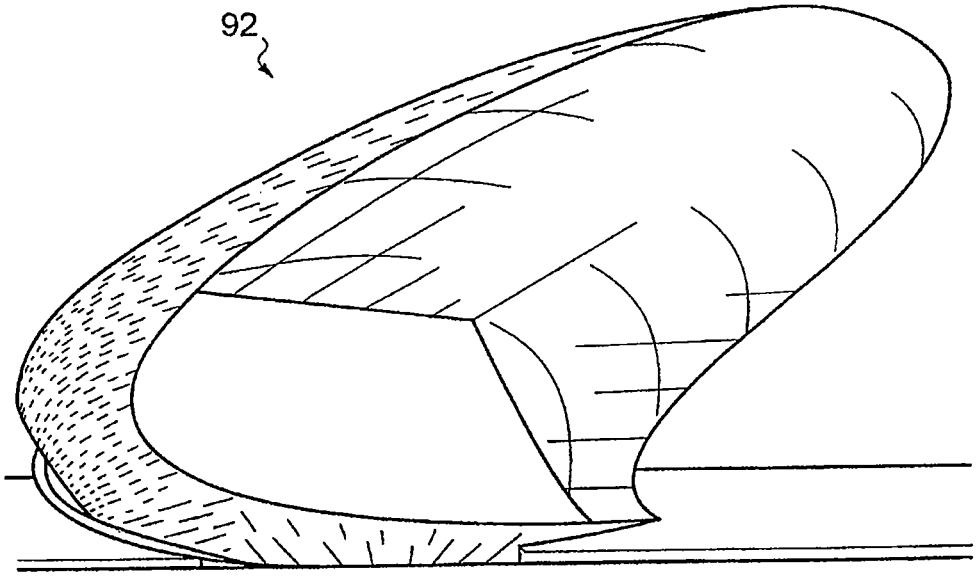
FIG. 10 is a perspective view of a stylised outer cladding of a free standing performance structure for an orchestra.

The outer cladding 92 may for example have a shape as indicated in FIG. 10 which shows the shape of an outer cladding suitable for accommodating a large sized shell 1 with a performance area accommodating an eighty piece orchestra. Details of the shell 1 and support structure 91 are omitted from FIG. 10 for simplicity.

Alternative embodiments are envisaged in which the sound shell 1 is free standing and the reflecting surfaces are provided by materials of sufficient strength for the structure to be self supporting without need for a separate supporting structure or outer cladding.

In the described embodiment, the sound diffusion formations are formed of part cylindrical surfaces. Alternative embodiments are envisaged in which different shaped reflectors are used, a number of different possible combinations of surface formation being possible to achieve essentially the same result of diffusing sound with minimum absorption.

In the above embodiment, the reflectors may conveniently be formed of plywood which may be lacquered and finished to have good reflective properties. Other materials may be used provided that they have sufficient density, typically at least 10kg per square meter.

The dimensions given for the above large sized sound shell can be scaled down to arrive at dimensions for the medium sized sound shell and small sized sound shell, or scaled up to arrive at dimensions for a super sized shell. The relations $G=2.4D\pm10\%$, $C=1.43B\pm10\%$ and $D=0.5A\pm10\%$ and $H=A\pm10\%$ still hold true.

The invention claimed is:

1. A free standing performance structure for outdoor music performance comprising:

A performance shell including:

a raised platform providing a performance area having a size for receiving at least one musician, the platform combining with a rear wall reflector, side wall reflectors and a canopy reflector to define an enclosure having a front opening for communicating acoustically with an open air audience area;

the canopy reflector comprising a main portion extending above the performance area and a projecting portion projecting forwardly of a front edge of the platform, the canopy reflector further comprising sound diffusion formations comprising a plurality of convex reflectors supported by an underside of the main portion and the projecting portion configured to provide non-specular reflection of sound from the at least one musician both towards the performance are and the audience area; and the convex reflectors extending transversely with respect to the platform, the convex reflectors of the main portion being positioned in an array having an arcuate profile when viewed in side elevation, which profile is concave relative to the performance area to assist in forwardly projecting the sound from the at least one musician towards the audience area;

a support structure supporting at least the canopy reflector; and an outer cladding encasing the performance shell and support structure.

2. A free standing performance structure as claimed in claim 1 wherein the side wall reflectors and the rear wall reflector comprise planar reflecting surfaces.

3. A free standing performance structure as claimed in claim 1 wherein the main portion of the canopy reflector comprises said plurality of convex reflectors distributed over a concave part-cylindrical surface extending from a top edge of the rear wall reflector to a position vertically above the front edge of the performance area.

4. A free standing performance structure as claimed in claim 3 wherein the convex reflectors have a radius of curvature in the range 2.8 to 4.2 meters.

5. A free standing performance structure as claimed in claim 1 wherein each of the reflectors is formed of material having a density of least 10 kilograms per square meter.

6. A free standing performance structure as claimed in claim 1 wherein the height of the canopy reflector above the front edge of the performance area is G, the height of the back wall is D, and G and D are related by the equation G=2.4D±10%.

7. A free standing performance structure as claimed in claim 1 wherein the separation between the side walls at the front of the performance area is C, the separation of the side walls at the rear of the platform is B, and wherein C and B are related by the equation C=1.43B±10%.

8. A free standing performance structure as claimed in claim 1 wherein the height of the back wall reflector is D, the depth of the performance area from its front edge to rear edge is A, and wherein D and A are related to the equation D=0.5A±10%.

9. A free standing performance structure as claimed in claim 1 wherein the projecting portion of the canopy reflector extends from the main portion at an angle of elevation in the range 0 to 10 degrees above the horizontal.

10. A free standing performance structure as claimed in claim 3 wherein the arc radius of the canopy reflector is H, the depth of the performance area from its front edge to rear edge is A, and wherein H and A are related by the equation H=A±10%.

11. A free standing performance structure as claimed in claim 1 wherein the projecting portion of the canopy reflector projects forwardly from the main portion by a distance of not less than 10 meters.

12. A free standing performance structure as claimed in claim 1 wherein the front edge of the performance area is defined by a line joining the points of intersection of the platforms and front edges of the side wall reflectors.

13. A free standing performance structure as claimed in claim 1 wherein the performance shell, support structure and the outer cladding are of demountable modular construction.

14. A free standing performance structure for outdoor music performance comprising;

a sound shell comprising a platform, a rear wall reflector and side wall reflectors and defining a front opening for communicating acoustically with an open air audience area, the platform providing a performance area having a size for receiving at least one sound source comprising one of a musician having an instrument, a singer or an orator;

a supporting structure comprising a framework within which the sound shell is located and supporting the sound shell with the platform in a raised position, the supporting structure providing a canopy comprising a main portion extending above the platform and a projecting portion projecting forwardly of a front edge of the platform;

an outer cladding enveloping the supporting structure and the sound shell leaving open the front opening and formed of substantially acoustically neutral materials to avoid reflections and absorption; and an array of sound diffusion formations comprising a series of convex reflectors attached to the framework and distributed over an underside of the main portion and the projecting portion configured to provide non-specular reflection of sound from the at least one sound source both towards the performance area and the audience area.

15. A free standing performance structure for outdoor music performance comprising;

a sound shell comprising a platform, a rear wall reflector and side wall reflectors and defining a front opening for communicating acoustically with an open air audience area, the platform providing a performance area having a size for receiving at least one sound source comprising one of a musician having an instrument, a singer or an orator;

a supporting structure comprising a framework within which the sound shell is located and supporting the sound shell with the platform in a raised position, the supporting structure providing a canopy comprising a main portion extending above the platform and a projecting portion projecting forwardly of a front edge of the platform;

an array of sound diffusion formations comprising a series of convex reflectors attached to the framework and distributed over an underside of the main portion and the projecting portion of the canopy, the array of sound diffusion formations being configured to provide non-specular reflection of sound from the at least one sound source both towards the performance area and the audience area, the convex reflectors extending transversely with respect to the platform, and wherein the convex reflectors supported by the main portion have positions defining an arcuate profile when viewed in side elevation, which profile is concave relative to the platform; and an outer cladding encasing the sound shell and supporting structure.

16. A free standing performance structure for outdoor music performance comprising;

a sound shell comprising a platform, a rear wall reflector, side wall reflectors and a canopy reflector and defining a front opening for communicating acoustically with an open air audience area, the platform providing a performance area having a size for receiving at least one sound source comprising one of a musician having an instrument, a singer or an orator;

the canopy reflector comprising a main portion extending above the performance area and a projecting portion projecting forwardly of a front edge of the platform;

a supporting structure comprising a framework within which the sound shell is located and supporting the sound shell with the platform in a raised position;

an outer cladding enveloping the supporting structure and the sound shell leaving open the front opening and formed of substantially acoustically neutral materials to avoid reflections and absorption; and wherein the side wall reflectors are splayed in the forward direction so that the separation, C, between the side wall reflectors at the front of the platform is greater than the separation, B, between the side wall reflectors at the back of the platform and wherein C and B are related by the equation C=1.43B±10%.

17. A free standing performance structure for outdoor music performance, comprising:

a platform providing a performance area having a size for receiving at least one sound source comprising one of a musician having an instrument, a singer or an orator, the platform combining with a rear wall reflector, side wall reflectors and a canopy reflector to define an enclosure having a front opening for communicating acoustically with an open air audience area;

the canopy reflector comprising a main portion extending above the platform and a projecting portion projecting forwardly of a front edge of the platform, the canopy reflector comprising a series of reflectors arranged along a path which extends from a rear of the platform to a front of the projecting portion with the reflectors extending transversely of the path and in side by side relationship with each other, which path is at a height above the platform which increases progressively from the rear of the platform to the front of the projecting portion, the path comprising a first portion above the platform and a second portion corresponding to the projecting portion, wherein at least the first portion of the path is concave relative to the performance area when viewed in side elevation;

a support structure supporting at least the canopy reflector; and an outer cladding encasing the enclosure and the support structure;

wherein the reflectors of the series of reflectors are shaped and arranged so as to provide a combination of surface formations resulting in non-specular reflection of sound by the canopy reflector from the at least one sound source both towards the performance area and the audience area.

* * * * *